US005884827A

United States Patent [19]

Stein

[11] Patent Number: 5,884,827

[45] Date of Patent: Mar. 23, 1999

[54] SPRING FOR A GOLF BAG STRAP

[75] Inventor: Louis Cobi Stein, Holyoke, Mass.

[73] Assignee: Lisco, Inc., Tampa, Fla.

[21] Appl. No.: 796,761

[22] Filed: Feb. 6, 1997

[51] Int. Cl.[6] ..... A45F 3/02; A63B 55/00

[52] U.S. Cl. ..... 224/614; 224/257; 206/315.3; 267/71

[58] Field of Search ..... 224/257, 258, 224/613, 614, 616, 617, 264; 206/315.3, 315.8; 267/70, 71, 72

[56] References Cited

U.S. PATENT DOCUMENTS

| | | | |
|---|---|---|---|
| 1,026,566 | 5/1912 | Cutler | 267/72 |
| 1,294,655 | 2/1919 | Hammers | 267/71 |
| 1,364,427 | 1/1921 | Corey | 267/71 |
| 1,471,121 | 10/1923 | Grasnick | 267/72 |
| 2,437,405 | 3/1948 | Robinson | 206/375.3 |
| 5,411,194 | 5/1995 | Nagasawa et al. | 224/257 |
| 5,615,811 | 4/1997 | Bell et al. | 224/258 |

*Primary Examiner*—Linda J. Sholl

[57] ABSTRACT

A spring interposed between a golf bag and a carrying strap for the golf bag. The spring will flex when the golf bag is carrying the golf bag thereby reducing the amount of stress placed on the shoulder of the golfer.

1 Claim, 4 Drawing Sheets

SPRING FOR A GOLF BAG STRAP

BACKGROUND OF THE INVENTION

1. Field of the Invention

The present invention relates to a spring for a golf bag strap and more particularly pertains to absorbing impact and pressure produced by the weight of a golf bag on a shoulder of a person carrying the golf bag with a spring for a golf bag strap.

2. Description of the Prior Art

The use of resilient shoulder straps is known in the prior art. More specifically, resilient shoulder straps heretofore devised and utilized for the purpose of reducing stress on a person's shoulder are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,544,795 to Perrin discloses a shock absorbing shoulder strap.

U.S. Pat. No. 5,499,761 to Reimers discloses an adjustable balance golf bag.

U.S. Pat. No. 5,411,194 to Nagasawa et al. discloses a shoulder strap assembly.

U.S. Pat. No. 5,072,867 to Zingale discloses a golf bag carrier and method therefor.

U.S. Pat. No. 4,976,388 to Coontz discloses a shoulder strap assembly having limited stretchability.

U.S. Pat. No. 4,911,347 to Wilhite discloses a carrier and locking seal for articulated drawing tubes and other cylindrical objects with slip on end caps.

U.S. Pat. No. 3,435,867 to Hyden discloses a resilient cover for golf bag strap.

U.S. Pat. No. 2,830,747 to Creste discloses rifles having slings.

While these devices fulfill their respective, particular objective and requirements, the aforementioned patents do not describe a spring for a golf bag strap for absorbing impact and pressure produced by the weight of a golf bag on a shoulder of a person carrying the golf bag.

In this respect, the spring for a golf bag strap according to the present invention substantially departs from the conventional concepts and designs of the prior art, and in doing so provides an apparatus primarily developed for the purpose of absorbing impact and pressure produced by the weight of a golf bag on a shoulder of a person carrying the golf bag.

Therefore, it can be appreciated that there exists a continuing need for new and improved spring for a golf bag strap which can be used for absorbing impact and pressure produced by the weight of a golf bag on a shoulder of a person carrying the golf bag. In this regard, the present invention substantially fulfills this need.

SUMMARY OF THE INVENTION

In the view of the foregoing disadvantages inherent in the known types of resilient shoulder straps now present in the prior art, the present invention provides an improved spring for a golf bag strap. As such, the general purpose of the present invention, which will be described subsequently in greater detail, is to provide a new and improved spring for a golf bag strap and method which has all the advantages of the prior art and none of the disadvantages.

To attain this, the present invention essentially comprises a golf bag defined by an open top, a closed bottom and a cylindrical side wall therebetween. The golf bag includes a plurality of stay rods extending between the open top and the closed bottom. A spring is included. The spring is comprised of a circular resilient segment having an elongated inner segment extending from a lower free end thereof and an elongated outer segment extending from an upper free end thereof with the inner segment and the outer segment in an essentially spaced and parallel relationship. The inner segment has an inwardly turned distal end. The inwardly turned distal end couples with an aperture formed in one of the plurality of stay rods of the golf bag with the inner segment extending upwardly along the stay rod in an abutting relationship. A pair of securement straps couple the inner segment of the spring to the stay rod of the golf bag. An upper strap is positioned adjacent to the circular resilient segment. A lower strap is positioned over the inwardly turned distal end coupled with the aperture in the stay rod. A securement buckle is secured to a distal end of the elongated outer segment of the spring. The securement buckle has a collar extending therefrom and is secured to the distal end of the outer segment of the spring. A shoulder strap is provided. The shoulder strap has a lower end secured to the golf bag and an upper end adjustably secured to the securement buckle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spring for a golf bag strap which has all the advantages of the prior art resilient shoulder straps and none of the disadvantages.

It is another object of the present invention to provide a new and improved spring for a golf bag strap which may be easily and efficiently manufactured and marketed.

It is a further object of the present invention to provide a new and improved spring for a golf bag strap which is of durable and reliable construction.

An even further object of the present invention is to provide a new and improved spring for a golf bag strap which is susceptible of a low cost of manufacture with regard to both materials and labor, and which accordingly is then susceptible of low prices of sale to the consuming public, thereby making such a spring for a golf bag strap economically available to the buying public.

Even still another object of the present invention is to provide a new and improved spring for a golf bag strap for absorbing impact and pressure produced by the weight of a golf bag on a shoulder of a person carrying the golf bag.

Lastly, it is an object of the present invention to provide a new and improved spring for a golf bag strap including a spring securable between a golf bag and an upper end of a shoulder strap of the golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
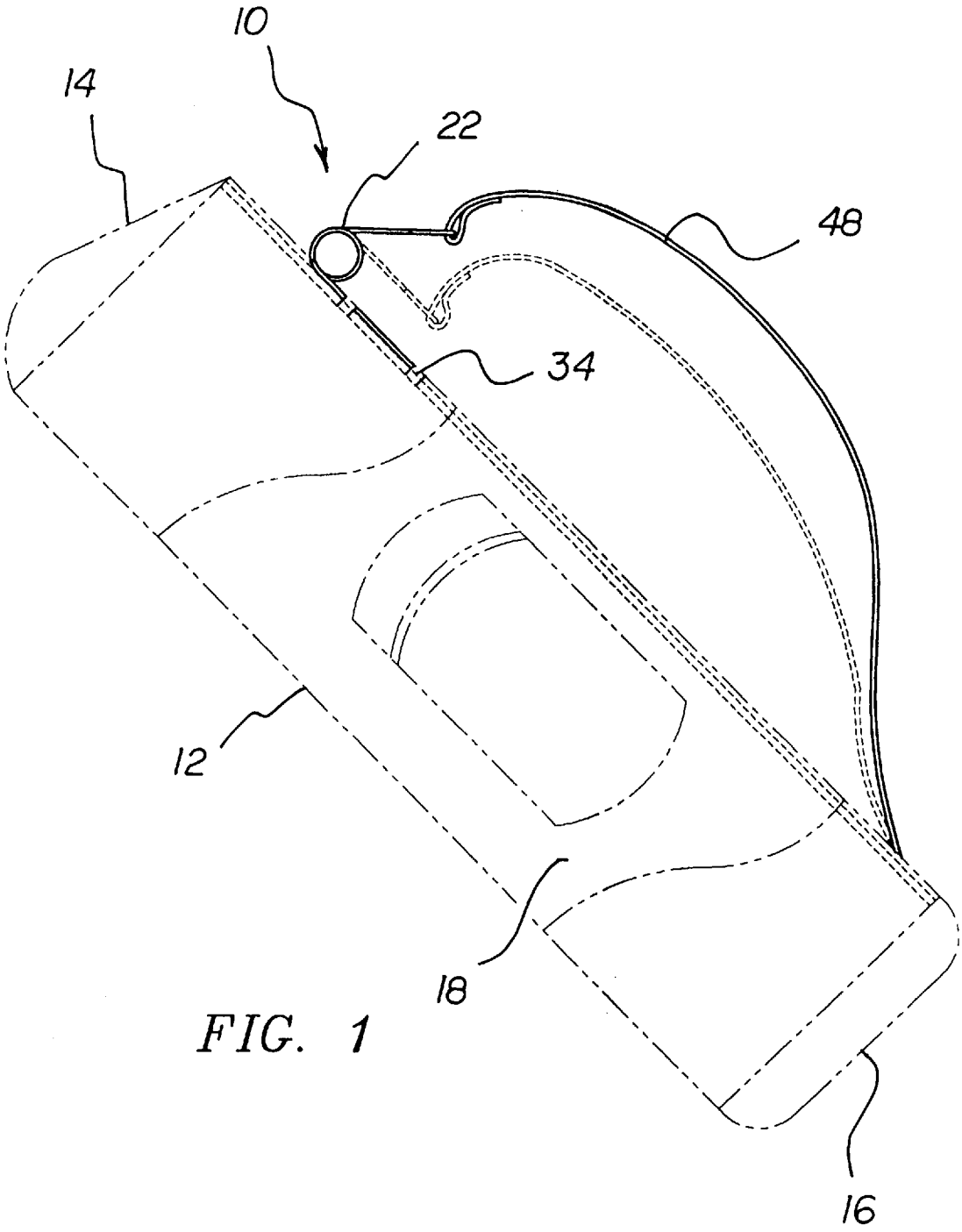
FIG. 1 is a side view of the preferred embodiment of the spring for a golf bag strap constructed in accordance with the principles of the present invention.

With reference now to the drawings, and in particular, to FIGS. 1 through 7 thereof, the preferred embodiment of the new and improved spring for a golf bag strap embodying the principles and concepts of the present invention and generally designated by the reference number 10 will be described.

Specifically, it will be noted in the various figures that the device relates to a spring for a golf bag strap for absorbing impact and pressure produced by the weight of a golf bag on a shoulder of a person carrying the golf bag. In its broadest context, the device consists of a golf bag, a spring, a pair of securement straps and a securement buckle. Such components are individually configured and correlated with respect to each other so as to attain the desired objective.

The device 10 is incorporated into a golf bag 12 defined by an open top 14, a closed bottom 6 and a cylindrical side wall 18 therebetween. Note FIG. 1. The golf bag includes a plurality of stay rods 20 extending between the open top and the closed bottom. The golf bag is of a standard configuration known in the art. The present invention can be constructed into new golf bags or it can be incorporated into existing golf bags.

Figure 2:
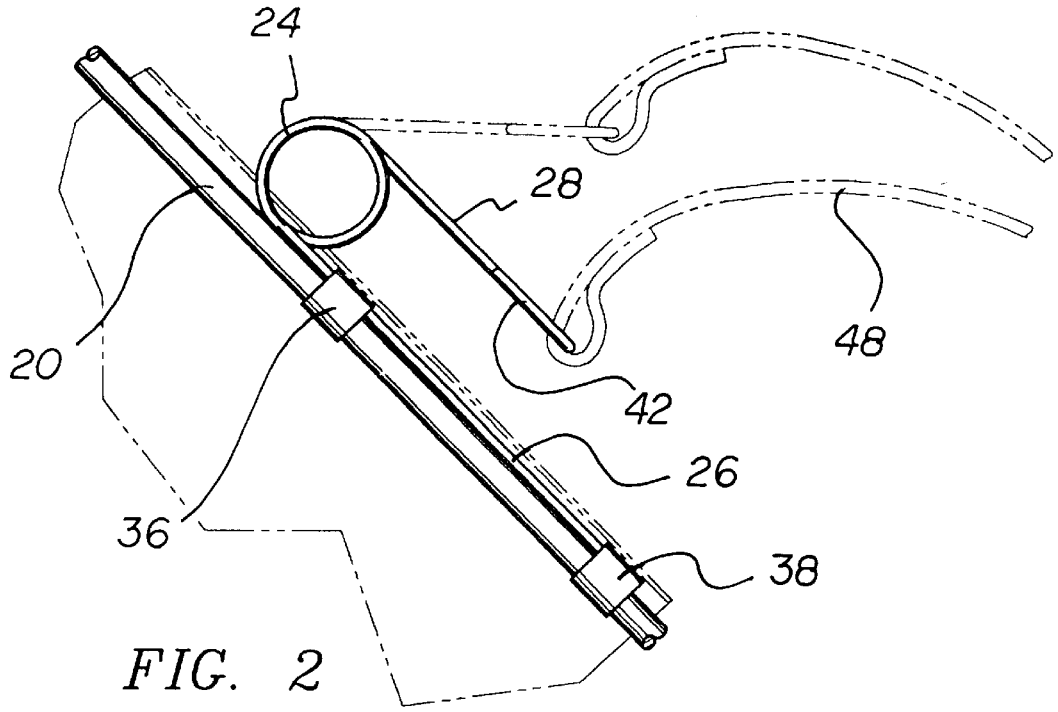
FIG. 2 is an isolated side view of the preferred embodiment attached to a golf bag stay rod.
Figure 3:
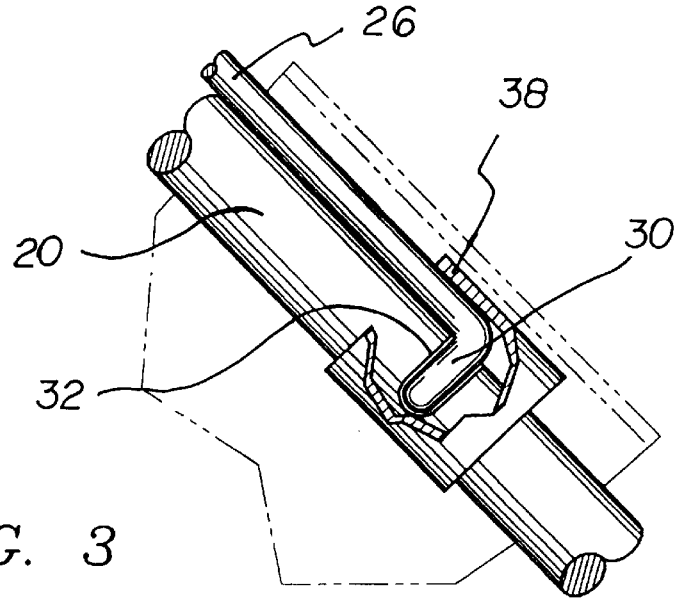
FIG. 3 is a side view of the preferred embodiment illustrating a means of securement to the stay rod.
Figure 4:
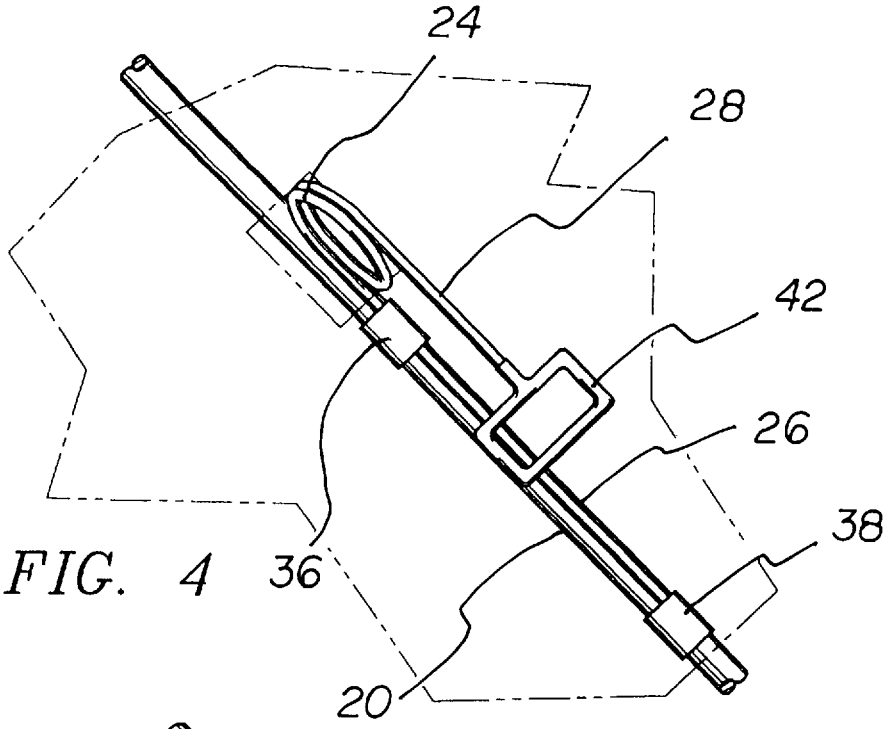
FIG. 4 is a top plan view of the preferred embodiment as illustrated in FIG. 2.
Figure 5:
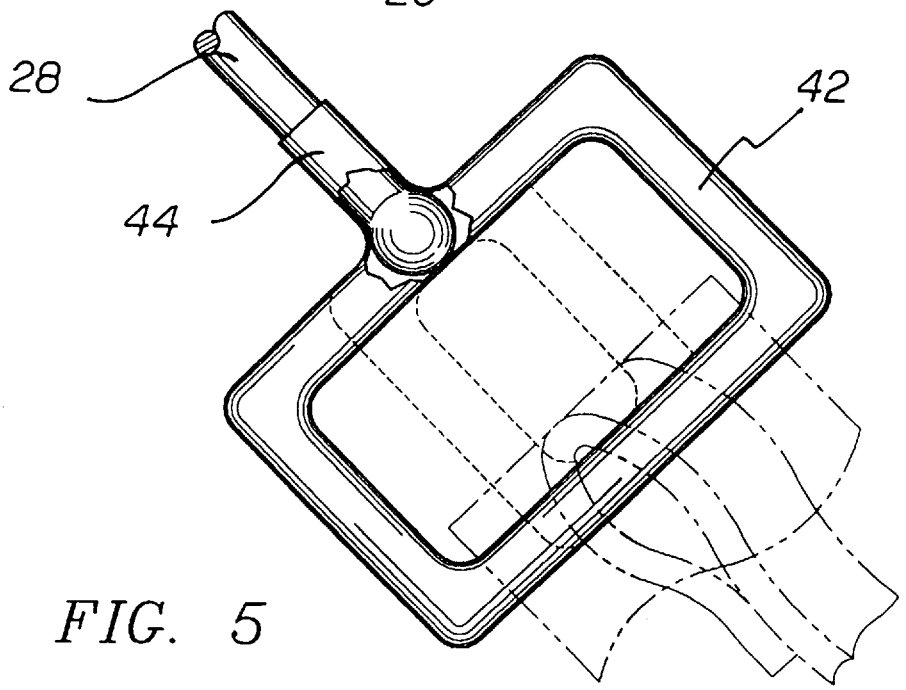
FIG. 5 is an isolated top plan view of the strap securement portion of the preferred embodiment as illustrated in FIG. 4.

A spring 22 is included in the present invention. The spring is best illustrated in FIGS. 2–4. The spring, as viewed from a side orientation as in FIG. 1, is in a generally V-shaped configuration. The spring is comprised of a circular resilient segment 24 having an elongated inner segment 26 extending from a lower free end thereof and an elongated outer segment 28 extending from an upper free end thereof with the inner segment and the outer segment in an essentially spaced and parallel relationship. The inner segment has a length greater than the outer segment. The inner segment has an inwardly turned distal end 30. The inwardly turned distal end couples with an aperture 32 formed in one of the plurality of stay rods of the golf bag with the inner segment extending upwardly along the stay rod in an abutting relationship. The inwardly turned distal end could alternately be coupled with respect to the stay rods. Alternate types of springs could also be incorporated into the present invention. One type of alternate spring would be a coil spring contained within a housing whereby the housing is constructed in upper and lower sections. The upper section is secured to an upper end of the coil spring and the lower section is secured to a lower end of the coil spring. The upper section would be secured to the golf bag with respect to the stay rods.

A pair of securement straps 34 couple the inner segment of the spring to the stay rod of the golf bag. Note FIGS. 2 and 4. An upper strap 36 is positioned adjacent to the circular resilient segment. A lower strap 38 is positioned over the inwardly turned distal end coupled with the aperture in the stay rod. Note FIG. 3. Alternate means for securement could be employed to secure the spring to the golf bag.

A securement buckle 42 is secured to a distal end of the elongated outer segment of the spring. Note FIG. 5. The securement buckle has a collar 44 extending therefrom and is secured to the distal end of the outer segment of the spring. The securement buckle can be provided to rotate with respect to the outer segment.

A shoulder strap 48 is provided. The shoulder strap has a lower end secured to the golf bag and an upper end adjustably secured to the securement buckle. The shoulder strap is preferably of a non-elastic fabrication so that the only flexibility provided is from the spring.

Figure 6:
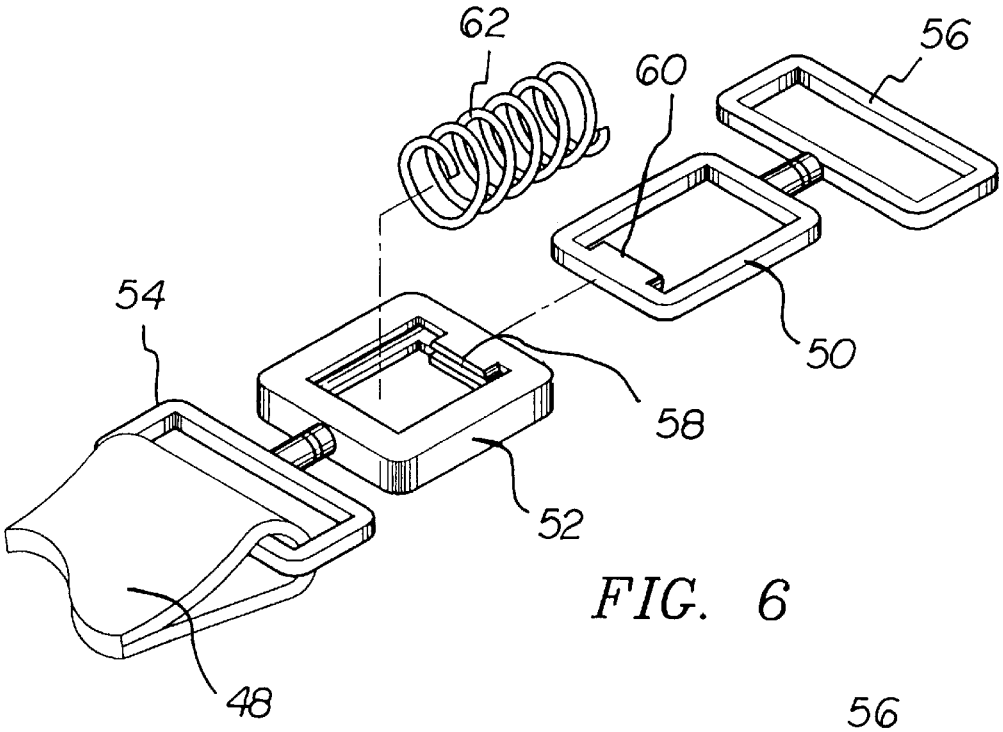
FIG. 6 is a perspective view of a second embodiment of the present invention.
Figure 7:
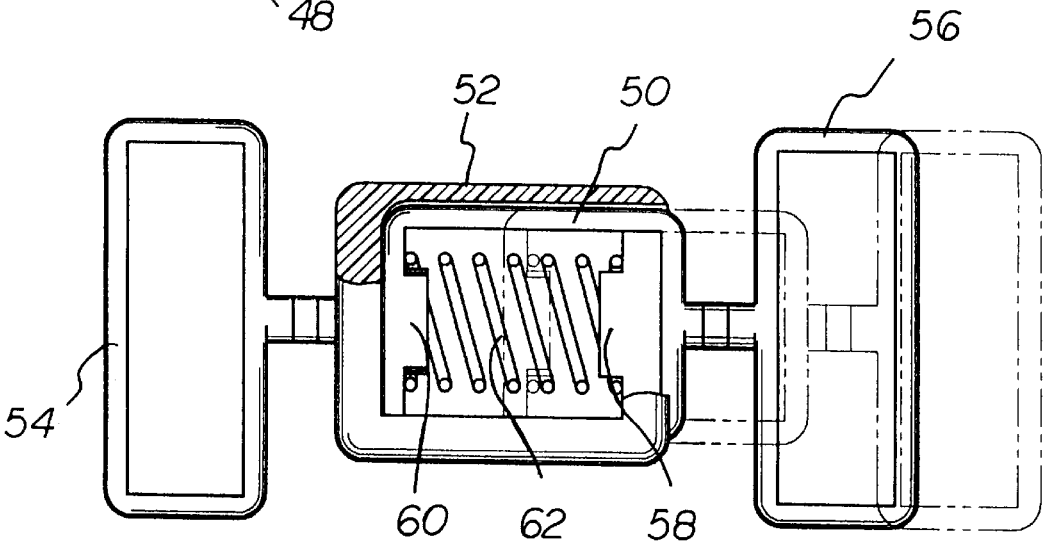
FIG. 7 is a top plan view of the second embodiment of the present invention.

FIGS. 6 and 7 illustrate an alternate embodiment of the present invention. In this embodiment a male 50 and female coupler 52 are employed. The female coupler has a buckle 54 for securement to the shoulder strap and the male coupler has a buckle 56 for securement to the golf bag. The female coupler has a tab 58 extending inwardly from its lower end while the male coupler has a tab 60 extending inwardly from its upper end. The male coupler is received within the female coupler whereby its tab is opposed from the tab of the female coupler. A spring 62 is disposed between the tabs. In operation, tension will cause the shoulder strap to pull outwardly on the female coupler causing the spring to retract to absorb the tension.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spring for a golf bag strap comprising:

a spring securable between a golf bag and an upper end of a shoulder strap of the golf bag;

wherein the spring includes a male and female coupler, the female coupler having a buckle for securement to the shoulder strap and the male coupler having a buckle for securement to the golf bag, the female coupler having a tab extending inwardly from its lower end, the male coupler having a tab extending inwardly from its upper end, the male coupler received within the female coupler whereby its tab is opposed from the tab of the female coupler with a coil spring disposed between the tabs;

wherein the female coupler includes a sleeve with an upper inner edge and a pair of side inner edges which extend to an opening formed in the lower end of the female coupler and wherein the male coupler includes an upper member, a lower member and a pair of side members coupled therebetween which define a closed loop which encompasses the coil spring such that the side members flank the spring and slidably abut the side inner edges of the female coupler for partially exiting the opening of the female coupler during use.

* * * * *